US008028366B2

(12) United States Patent
Grabowski

(10) Patent No.: US 8,028,366 B2
(45) Date of Patent: Oct. 4, 2011

(54) TOOL FOR CLEANING TILE AND GROUT

(75) Inventor: Brian Grabowski, Brunswick, OH (US)

(73) Assignee: The Scott Fetzer Company, Cleveland, OH (US)

( * ) Notice: Subject to any disclaimer, the term of this patent is extended or adjusted under 35 U.S.C. 154(b) by 59 days.

(21) Appl. No.: 12/539,868

(22) Filed: Aug. 12, 2009

(65) Prior Publication Data

US 2011/0035893 A1 Feb. 17, 2011

(51) Int. Cl.
*A46B 9/02* (2006.01)

(52) U.S. Cl. ..... 15/106; 15/160; 15/DIG. 5

(58) Field of Classification Search ..... 15/106, 15/159.1, 160, DIG. 5, DIG. 6; D4/119, D4/120, 127, 128, 130, 132, 133; D32/50
See application file for complete search history.

(56) References Cited

U.S. PATENT DOCUMENTS

| | | | | |
|---|---|---|---|---|
| 4,422,202 | A * | 12/1983 | Malvasio | 15/106 |
| 4,472,853 | A * | 9/1984 | Rauch | 15/167.1 |
| 4,586,211 | A | 5/1986 | Phillips | |
| 4,831,678 | A * | 5/1989 | Dietsche | 15/176.4 |
| 5,537,707 | A * | 7/1996 | Middleton | 15/106 |
| 5,809,604 | A | 9/1998 | Olstyn | |
| 5,898,970 | A | 5/1999 | Straiton | |
| 6,073,298 | A | 6/2000 | O'Brien | |
| 6,076,221 | A | 6/2000 | Bradshaw | |
| 6,240,590 | B1 | 6/2001 | Nesbit | |
| 7,131,162 | B2 | 11/2006 | Anderson | |
| 7,225,501 | B2 | 6/2007 | Gordon et al. | |
| 7,363,673 | B2 | 4/2008 | Schonewille et al. | |
| 2005/0086755 | A1 * | 4/2005 | Dalias | 15/111 |
| 2005/0160544 | A1 * | 7/2005 | Geller | 15/160 |

* cited by examiner

*Primary Examiner* — Mark Spisich
(74) *Attorney, Agent, or Firm* — Pearne & Gordon LLP

(57) ABSTRACT

A tile and grout cleaning tool that can be turned over to place either a first series of bristle bundles projecting from the head of the tool in position to clean tile surfaces or a second series of bristle bundles spaced from the first series in position to clean the grout between tiles, the second series of bristle bundles comprising bristles that can be pressed into the grout channels and have ends of different lengths that form rough cleaning surfaces.

5 Claims, 3 Drawing Sheets

TOOL FOR CLEANING TILE AND GROUT

BACKGROUND OF THE INVENTION

1. Field of the Invention

The present invention relates generally to cleaning devices, and more particularly to a hand-manipulated tool for cleaning uneven surfaces of tile floors and walls and the grout between the tiles.

2. Background Information

It is well known that it is difficult to adequately clean the surfaces of rough tile, such as stone, tile and the like, and the recessed, rough grout between the tiles. Because of this difficulty, many different types of cleaning implements ranging from machines with power driven brushes to hand manipulated brushes with fixed bristles have been proposed in the past. Many of the known implements have been specifically designed to clean either tile or grout, and are not useful to clean both tile and grout in an acceptable and easily used manner.

The use of hand brushes intended to enter and clean channels of grout typically require the user to wear gloves and exert considerable effort to accomplish an acceptable cleaning result. Long-handled cleaning brushes have been awkward to manipulate while maintaining the brush elements in contact with the tile grout.

SUMMARY OF THE INVENTION

An object of the present invention is to provide a single, easily used tool that makes it possible to clean tile and the grout between the tiles in an improved manner.

The tile and grout cleaning tool of the invention generally comprises a first series of bristle bundles adapted to clean tile surfaces in one position of the tool and a second series of bristle bundles adapted to clean the grout between the tiles in another position of the tool.

In a specifically disclosed embodiment, the tool has a cylindrical head that carries rows of tile cleaning bristle bundles extending lengthwise of the head around a first section of its periphery. Arrays of grout cleaning bristle bundles are spaced lengthwise of the head around a second section of its periphery. The grout cleaning bristle bundles comprise bristles that have the flexibility to permit them to be pressed into grout channels between tiles and ends of unequal lengths that form uneven grout cleaning surfaces.

In order to maintain the grout cleaning bristles in the recessed grout channels when the tool is pushed and pulled, the bristles may be arranged in diamond shaped arrays. Each diamond shaped array presents pointed, leading ends which enable the grout cleaning bristles to stay in the channels of grout with little effort by the user.

DETAILED DESCRIPTION OF A PREFERRED EMBODIMENT

Figure 1:
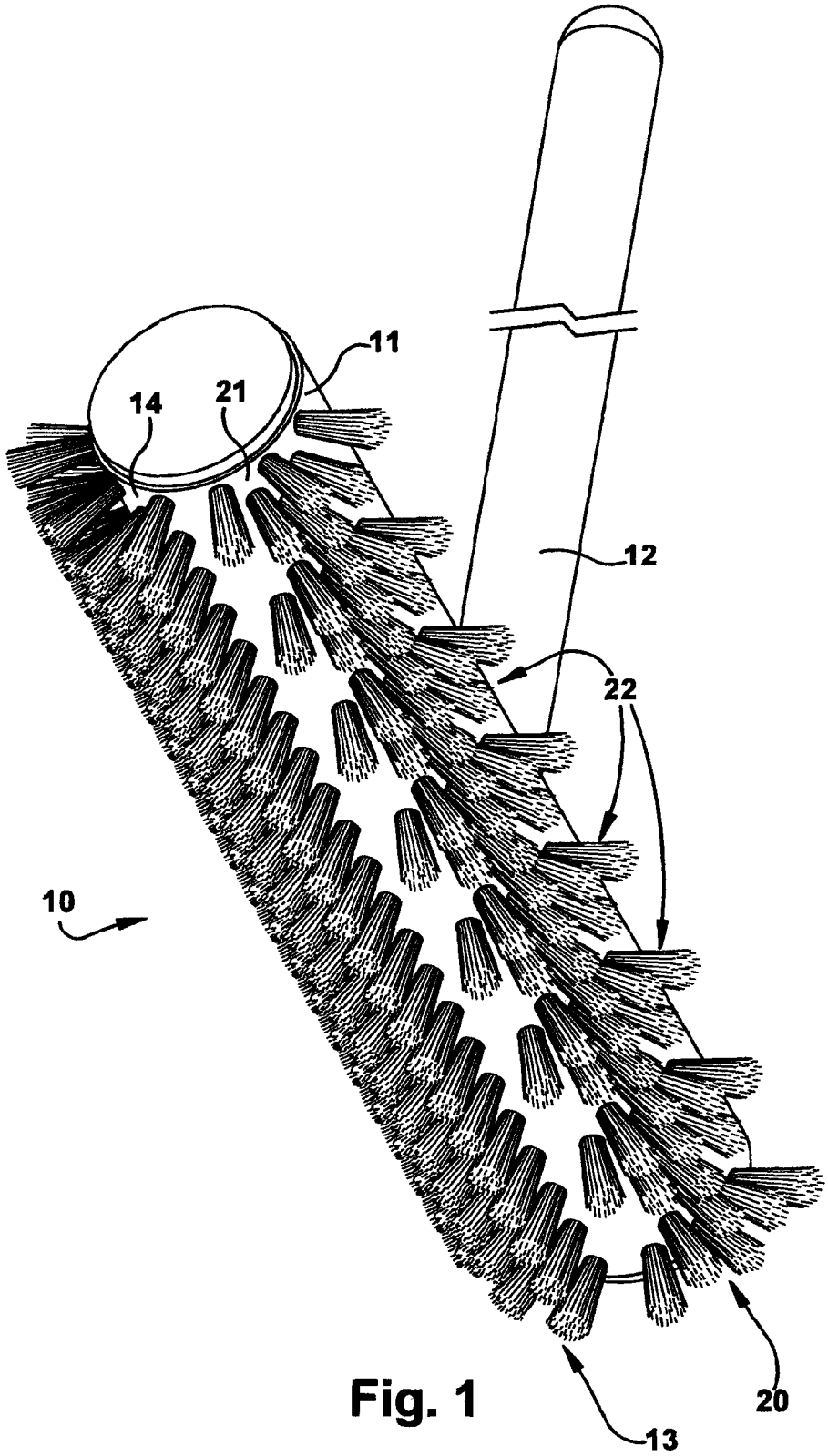
FIG. 1 is a foreshortened perspective view of the tile and grout cleaning tool of invention.
Figure 2:
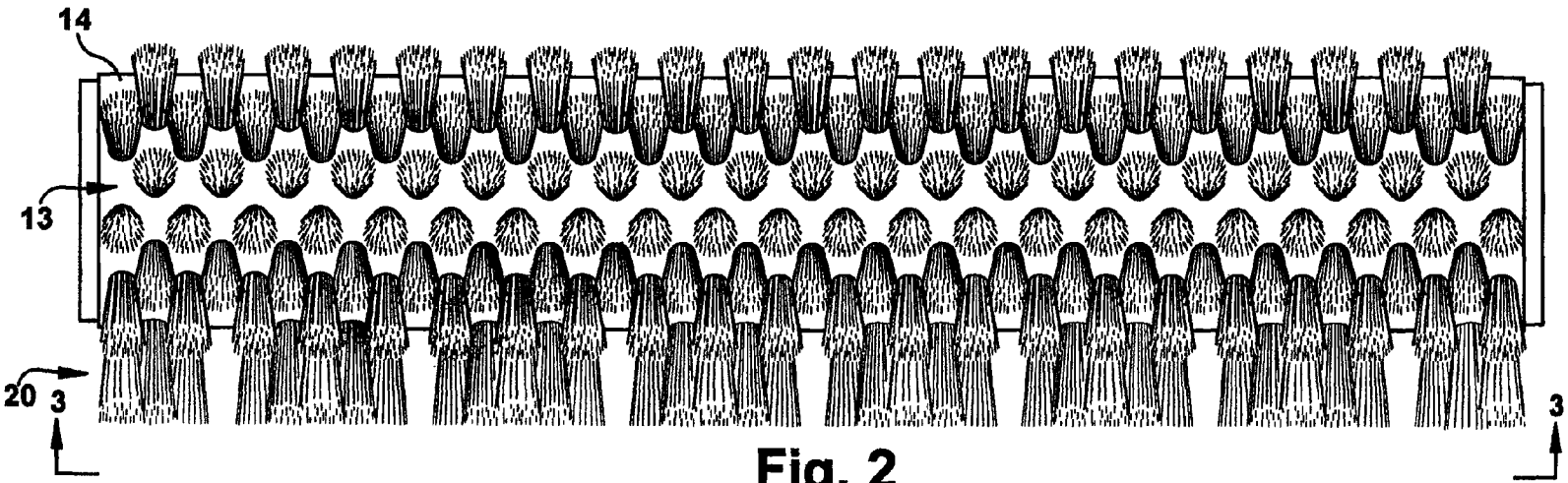
FIG. 2 an elevational view of the tool head.

Referring to the drawings, the tile and grout cleaning tool of the invention is generally designated by reference numeral

10. The tool 10 comprises a cylindrical head 11 and a long, extended handle 12 for manipulating the tool. As most clearly shown in FIGS. 4 and 5, a first series of bristle bundles 13 are arranged in rows extending lengthwise of the head 11 around a first section 14 of its circumference, and a second series of bristle bundles 20 extending along the length of the head 11 around a second section 21 of its circumference.

Figure 5:
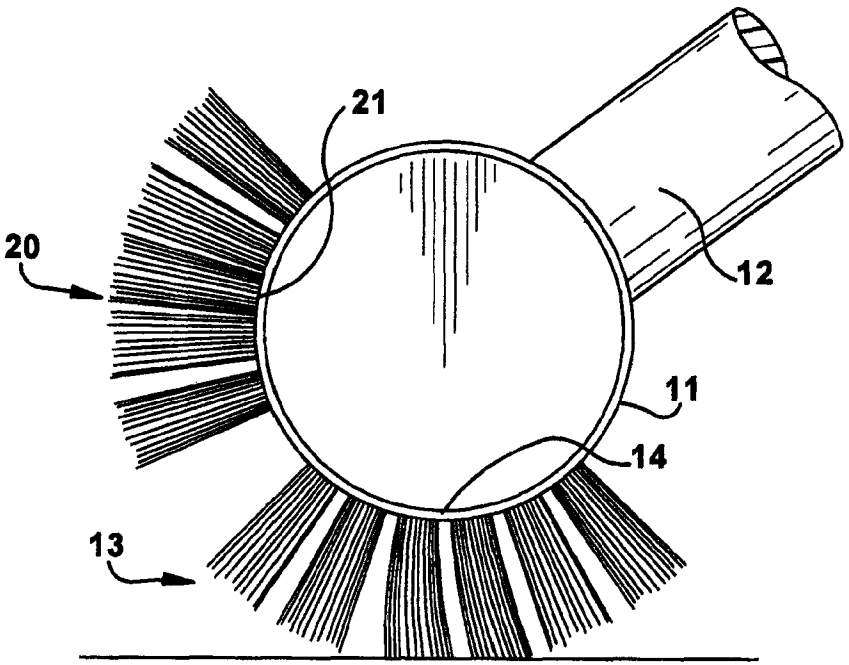
FIG. 5 is an end elevational view of the tool in its second operative position.

The peripheral sections 14, 21 containing the bundles of bristles 13, 20, respectively, are circumferentially spaced apart so that the bristles of bundles 13 can contact and clean the tile surfaces of tile floors and walls in one position of the tool head shown in FIG. 5. In another position of the tool head 11 shown in FIG. 4, the bristles of the bundles 20 can enter the spaces between the tiles in order to contact and clean the grout.

Figure 3:
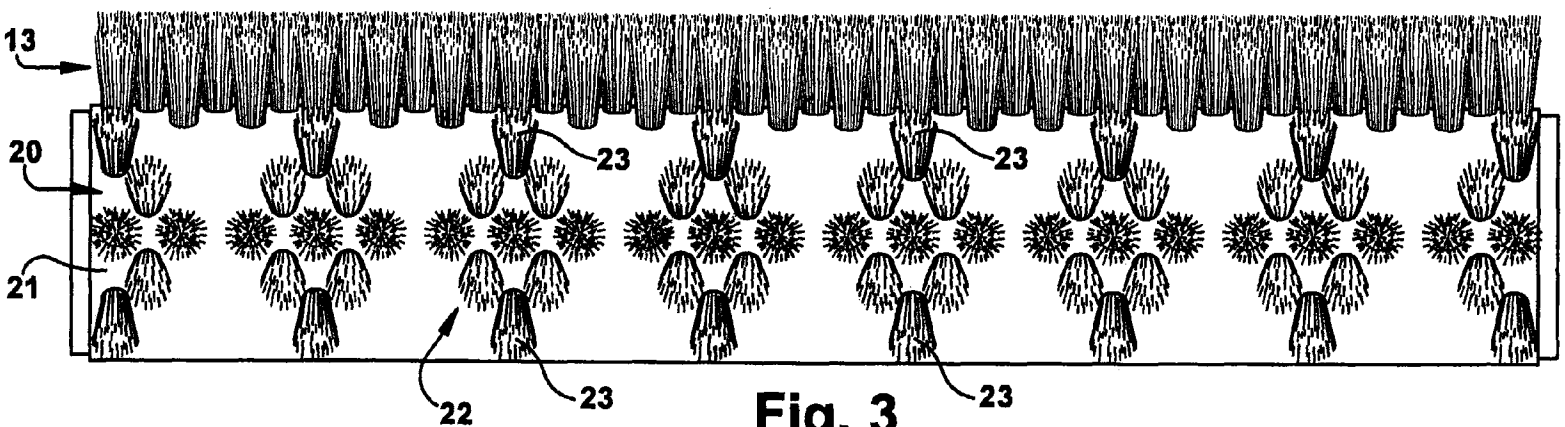
FIG. 3 is an elevational view taken in the plane 3-3 of FIG. 2.

As most clearly shown in FIG. 3, the bristle bundles 20 form diamond shaped arrays 22. The diamond shaped arrays present pointed leading ends 23 when the tool 10 is pushed and pulled across a tile floor or wall. The pointed ends 23 of the diamond shaped arrays 22 make it easy to engage and maintain the bristles in channels of grout between tiles. The several diamond shape arrays 22 assure that an array will be engaged in a grout channel even though the tool is not pushed or pulled in a straight line cleaning stroke.

Figure 4:
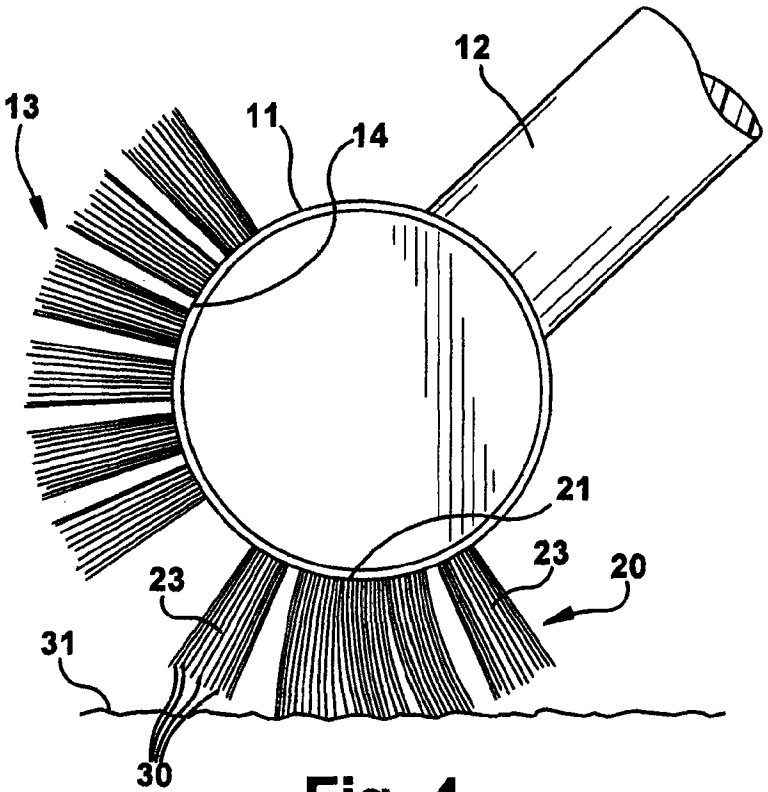
FIG. 4 is an end elevational view of the tool in one operative/position.

Referring to FIGS. 4 and 5, it will be seen that the bristle bundles 20 are made up of individual bristles 30, the ends of which are of uneven lengths so that each bundle presents an uneven cleaning surface. The uneven cleaning surfaces formed by the bristles 30 enhance the ability of the tool 10 to clean the rough grout 31 between tiles as shown in FIG. 4. During manufacture, blind holes are drilled into the head 11 for receiving the bristles 30. The bristles 30 are laid across the holes and are engaged between their ends by punches that press the bristles down into the blind holes. This operation results in the bristles 30 extending from the head 11 in different random lengths.

The tile cleaning bristle bundles 13, which can be made in the same manner as the bristle bundles 20, are closely spaced along the head 11 and form a compact brush portion suitable for cleaning the surfaces of multiple tiles. The close spacing of the bristles of the bundles 13 make these bristles stiff enough to resist being pressed into the grout channels. As compared to the rows of tile cleaning bristle bundles 13, the bristles 30 of the bundles 20 are more widely spaced apart to provide flexability so that they can be pressed into grout channels when the tool 10 is in the position shown in FIG. 4.

In use, the handle 12 is manipulated to place the bristles projecting from a selected one of the sections 14, 21 into cleaning contact with either tile or grout. FIG. 5 shows the bristle bundles 13 in position to clean tile surfaces, while the bristle bundles 20 are out of contact with the grout between the tiles. The tool is then pushed or pulled across the tile surfaces to affect a cleaning action. When it is desired to clean the grout between the tiles, the tool head 11 is simply turned over, end-for-end so as to place the bundles of bristles 20 in the position shown in FIG. 4 to clean the grout.

It will be seen from the above that the invention accomplishes the objective of providing a single tool for effectively cleaning both tile and grout. In one position of the tool, bristles specifically made to clean grout are brought into contact with the grout. The improved grout cleaning action is due in large part to the unequal lengths of the bristles 30 projecting from the toolhead, and can be enhanced by arranging the bristles in diamond shaped arrays shown in the drawings. In another position of the tool, the more closely spaced bristles of the bundles 13 form stiffer brush portion that can efficiently clean tile surfaces.

Many variations and modifications of the invention will be apparent to those skilled in the art in light of the detailed disclosure. Therefore, it is to be understood that, within the scope of the appended claims, the invention can be practiced otherwise than as specifically shown and described.

What is claimed is:

1. A tile and grout cleaning tool comprising:

a cylindrical head having first and second, peripherally spaced, longitudinally extending bristle sections, one of said sections having rows of tile cleaning bristle bundles closely spaced along said head to form a compact brush portion suitable for cleaning the surfaces of multiple tiles, the close spacing of the bristles of said tile cleaning bristle bundles making them stiff enough to resist collapsing when pressed against tile surfaces, the other of said sections containing discrete arrays of grout cleaning bristle bundles spaced along said head, said grout cleaning bristle bundles being fewer in number and spaced wider apart than said tile cleaning bristle bundles to provide bristle flexibility, whereby bristles in an array pressed against tile surfaces will flex to allow other bristles in the array to penetrate into a grout channel, and a handle attached to said head so that it can be turned over, end-to-end to place a selected one of said sections into cleaning position.

2. A tool as claimed in claim 1 wherein the individual bristles in a grout cleaning bristle bundle have different random lengths so that their ends are uneven in order to clean uneven grout surfaces.

3. A tool as claimed in claim 2 wherein the individual bristles in a tile cleaning bristle bundle have different random lengths so that their ends are uneven in order to clean uneven surfaces.

4. A tool as claimed in claim 1 wherein said arrays of grout cleaning bristle bundles are diamond shaped and present pointed leading ends when said tool is pushed and pulled.

5. A tile and grout cleaning tool compromising:

a cylindrical head having first and circumferential sections, rows of tile cleaning bristle bundles extending from said first section lengthwise of said head, said second section having arrays of grout cleaning bristle bundles that are spaced along said head and have bristles that can be pressed into grout channels between tiles, the bristles having ends of different lengths in order to present rough cleaning surfaces, said arrays being diamond shaped to present pointed ends when said tool is pushed and pulled, and a handle attached to said head for manipulating said tool.

* * * * *